US011421357B2

(12) United States Patent
Lin

(10) Patent No.: US 11,421,357 B2
(45) **Date of Patent: *Aug. 23, 2022**

(54) WOVEN TEXTILE

(71) Applicant: JING HUNG LIANG LTD., Changhua County (TW)

(72) Inventor: Ping-Kun Lin, Changhua County (TW)

(73) Assignee: JING HUNG LIANG LTD., Changhua County (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/183,861

(22) Filed: Feb. 24, 2021

(65) Prior Publication Data

US 2021/0180226 A1 Jun. 17, 2021

Related U.S. Application Data

(63) Continuation-in-part of application No. 15/983,701, filed on May 18, 2018, now abandoned.

(51) Int. Cl.

| | |
|---|---|
| ***D03D 17/00*** | (2006.01) |
| ***D03D 11/00*** | (2006.01) |
| ***D03D 13/00*** | (2006.01) |
| ***D04C 1/06*** | (2006.01) |

(52) U.S. Cl.
CPC ..... *D04C 1/06* (2013.01); *D03D 17/00* (2013.01); *D10B 2401/061* (2013.01)

(58) Field of Classification Search
USPC ..... 139/383 A, 397, 398, 410, 411, 413; 442/206, 213, 243
See application file for complete search history.

(56) References Cited

U.S. PATENT DOCUMENTS

| | | | |
|---|---|---|---|
| 9,163,341 | B2 | 10/2015 | Nelis |
| 2005/0247367 | A1 | 11/2005 | Debaes |

*Primary Examiner* — Lynda Salvatore
(74) *Attorney, Agent, or Firm* — Muncy, Geissler, Olds & Lowe, P.C.

(57) ABSTRACT

A woven textile defines a longitudinal direction and a horizontal direction. The woven textile includes at least one first zone, at least one second zone, at least one first binding thread, and at least one second binding thread. The first zone includes at least one first braid. The first braid is woven by a plurality of filaments and extends in a sinusoidal wave pattern. The second zone includes at least one second braid. The second braid is woven by a plurality of filaments and extends in a sinusoidal wave pattern. The first zone and the second zone are aligned along the longitudinal direction. The first binding thread extends along the horizontal direction and is woven with the first braid. The second binding thread extends along the horizontal direction and is woven with the second braid.

5 Claims, 4 Drawing Sheets

WOVEN TEXTILE

The present invention is a CIP of application Ser. No. 15/983,701, filed May 18, 2018, the entire contents of which are hereby incorporated by reference.

BACKGROUND OF THE INVENTION

Field of the Invention

Description of the Prior Art

Woven textile is used widely. For example, clothes, shoes, and daily commodities are often made by woven textile. However, how the woven textile is woven, the material, and the design determine the characteristics of the woven textile.

In general way to weave, the maximum size of mesh is limited. To give a larger mesh, some difficult skills such as skipping are used, and the structure strength is reduced.

Besides, the elasticity at two perpendicular directions in a general woven textile usually vary because of the direction of weaving. That is, the elasticity in one direction may be too good to make the woven textile easy to deform.

US2005/0247367 discloses that the winding filament in the upper layer and the winding filament in the lower layer extending in a sinusoidal wave pattern as observed in the horizontal direction instead of the vertical direction. That is, the filaments look in a sinusoidal wave pattern at a cross-section along the thickness direction, just like FIG. 1*a* and FIG. 1*b*. Thus, FIG. 1*a* and FIG. 1*b* are obviously a cross-section view that observed along the horizontal direction. In addition, the reference number 6 is a "weft thread", which obviously extends along a surface of the fabric instead of the thickness direction. Other drawings also fail to teach that the filaments extend in a sinusoidal wave pattern along the horizontal plane. Furthermore, the filaments are woven together directly. Therefore, it fails to disclose the filaments extending in a sinusoidal wave pattern on a plane which is perpendicular to a thickness direction of the woven textile.

SUMMARY OF THE INVENTION

The main object of the present invention is to provide a woven textile whose elasticity is restricted in two directions but having appropriate elasticity.

To achieve the above and other objects, the woven textile of the present invention defines a longitudinal direction and a horizontal direction perpendicular to the longitudinal direction. The woven textile includes at least one first zone, at least one second zone, at least one first binding thread, and at least one second binding thread.

The at least one first zone includes at least one first braid. The at least one first braid is woven by a plurality of filaments and extends in a sinusoidal wave pattern. The at least one second zone includes at least one second braid. The at least one second braid is woven by a plurality of filaments and extends in a sinusoidal wave pattern. The at least one first zone and the at least one second zone are aligned along the longitudinal direction. The at least one first binding thread extends along the horizontal direction and is woven with the at least one first braid. The at least one second binding thread extends along the horizontal direction and is woven with the at least one second braid.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
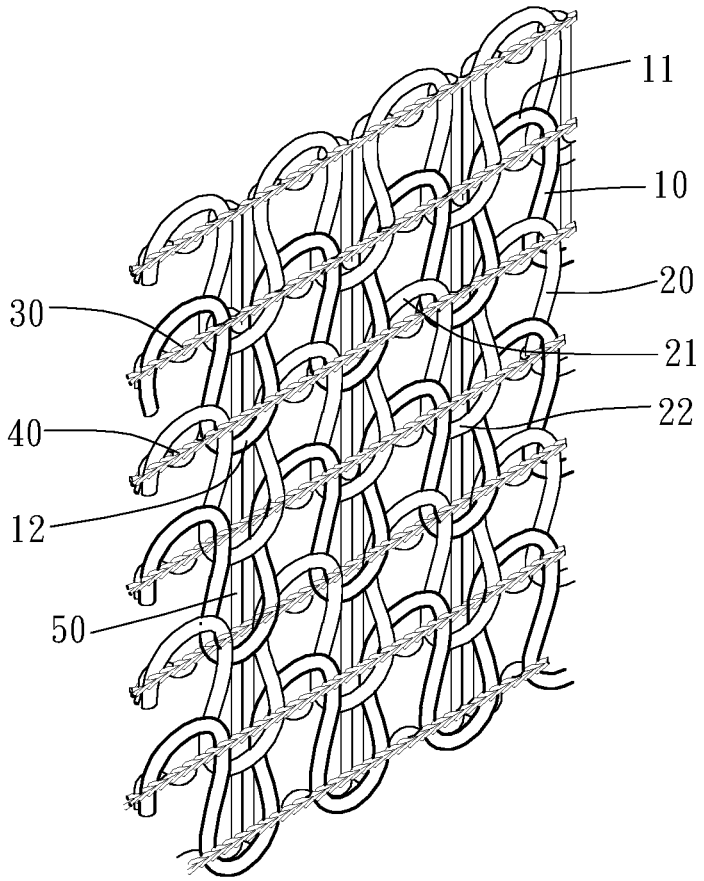
FIG. 1 is a stereogram of the present invention.
Figure 2:
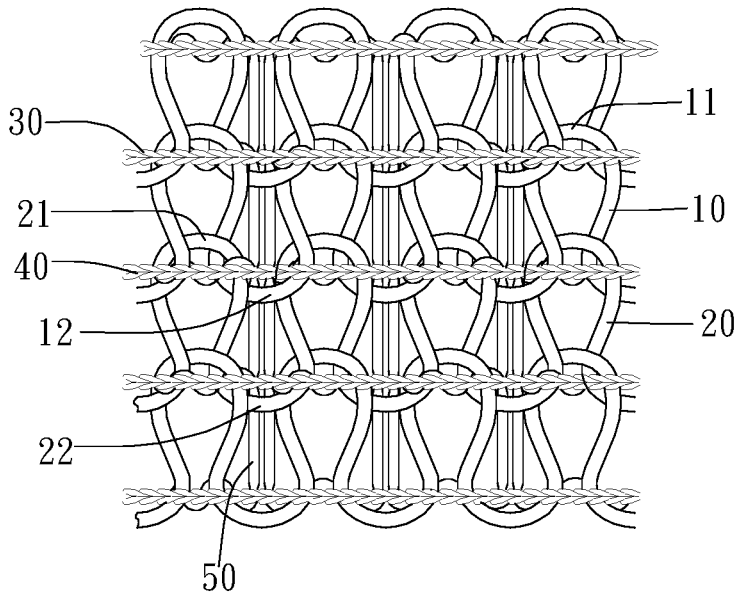
FIG. 2 is a top view of the present invention.
Figure 3:
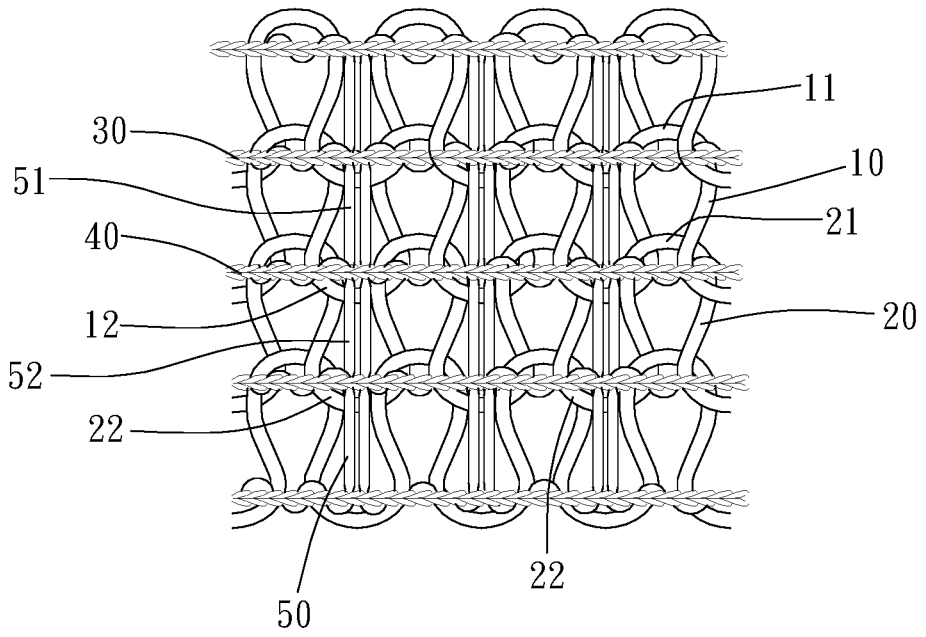
FIG. 3 is a bottom view of the present invention.
Figure 4:
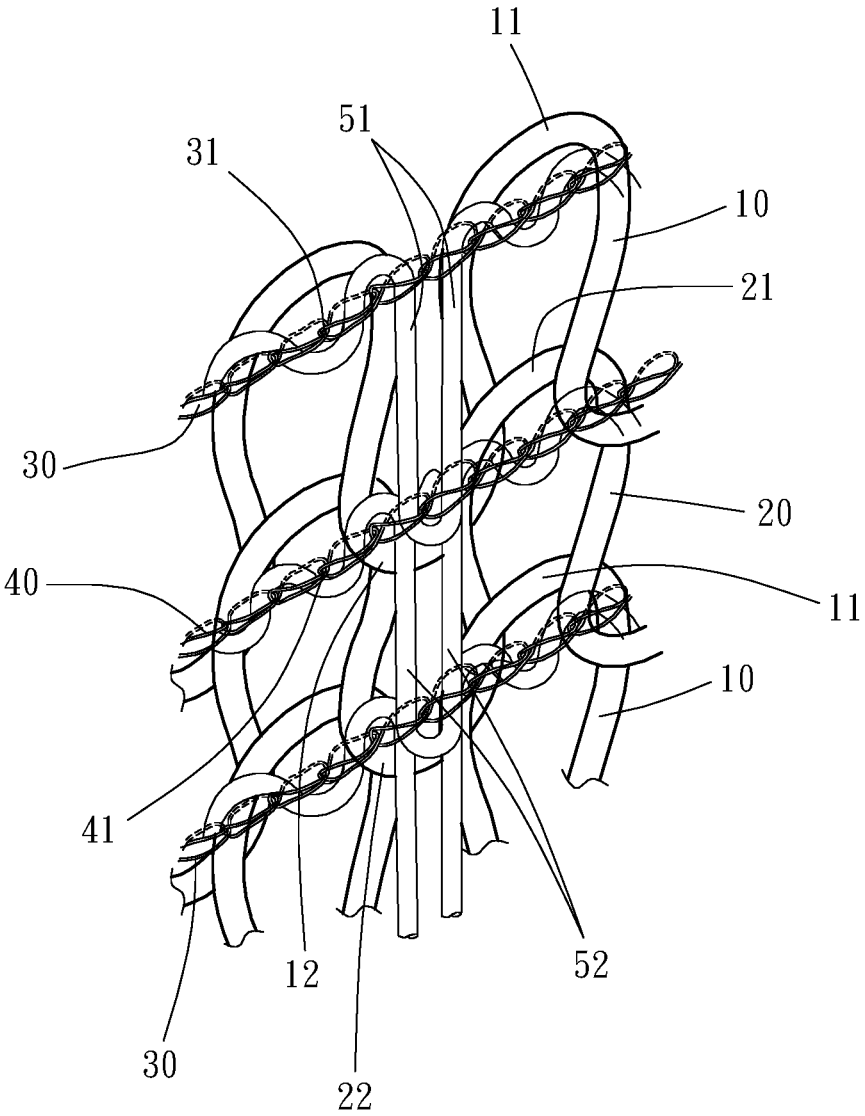
FIG. 4 is a partial enlargement of the present invention.

Please refer to FIG. 1 to FIG. 4, the woven textile of the present invention defines a longitudinal direction and a horizontal direction perpendicular to the longitudinal direction. The woven textile includes at least one first zone, at least one second zone, at least one first binding thread 30, at least one second binding thread 40, and at least one third braid 50.

The at least one first zone includes at least one first braid 10. The at least one first braid 10 is woven by a plurality of filaments and extends in a sinusoidal wave pattern. The at least one second zone includes at least one second braid 20. The at least one second braid 20 is woven by a plurality of filaments and extends in a sinusoidal wave pattern. The at least one first zone and the at least one second zone are aligned along the longitudinal direction. The at least one first binding thread 30 extends along the horizontal direction and is woven with the at least one first braid 10. The at least one second binding thread 40 extends along the horizontal direction and is woven with the at least one second braid 40. The at least one third braid 50 is woven with the at least one first binding thread 30 and then jumps to the at least one second binding thread 40 to be woven with the at least one second binding thread 40.

In the present embodiment, the woven textile of the present invention includes a plurality of the first zones, a plurality of the second zones, a plurality of the first binding threads 30, and a plurality of the second binding threads 40. The first zones and the second zones are aligned in turn along the longitudinal direction. Any adjacent first zone and second zone overlap partially. Specifically, each of the first binding threads 30 or each of the second binding threads 40 is woven with the overlap portions of any adjacent first zone and second zone.

In the present embodiment, the first binding threads 30 are a single thread to extend back and forth, and the second binding threads 40 are also a single thread to extend back and forth. Each of the first braids 10 has a plurality of first crests 11 and a plurality of first troughs 12 arranged in turn. Each of the second braids 20 has a plurality of second crests 21 and a plurality of second troughs 22 arranged in turn. The first crests 11 and the second crests 21 positionally correspond to each other. The first troughs 12 and the second troughs 22 positionally correspond to each other. Each of the first crests 11 of each of the first braid 10 partially overlaps one of the second troughs 22 of an adjacent second braid 20. Each of the first troughs 12 of each of the first braid 10 partially overlaps one of the second crests 21 of an adjacent second braid 20. The at least one third braid 50 is woven with the first crests 11 and the first binding thread 30 and then jumps to an adjacent second binding thread 40 to be woven with the second binding thread 40 for a distance followed by jumping back to the first binding thread 30 to be woven with the following first crests 11 and the first binding thread 30. The at least one third braid 50 extends in such a way to be teeth-shaped. However, the first braid 10 and the second braid 20 can be exchanged.

In other possible embodiments, each of the first braids 10 has a plurality of first crests 11 and a plurality of first troughs 12 arranged in turn. Each of the second braids 20 has a plurality of second crests 21 and a plurality of second troughs 22 arranged in turn. The first crests 11 and the second crests 21 positionally correspond to each other. The first troughs 12 and the second troughs 22 positionally correspond to each other. Each of the first crests 11 of each of the first braid 10 partially overlaps one of the second troughs 22 of an adjacent second braid 20. Each of the first troughs 12 of each of the first braid 10 partially overlaps one of the second crests 21 of an adjacent second braid 20. The at least one third braid 50 is woven with the first crests 11 and the first binding thread 30 and then jumps to an adjacent second binding thread 40 to be woven with the second crests 21 and the second binding thread 40 followed by jumping to an other first binding thread 30 to be woven with the first crests 11 and the first binding thread 30. The at least one third braid 50 extends in such a way to be step-shaped.

Moreover, at least one third braid 50 extends in a sinusoidal wave pattern between the at least one first and second zones, the at least one first binding thread 30 at least ties the at least one third braid 50 to the at least one first braid 10, and the at least one second binding thread 40 ties the at least one third braid 50 to the at least one first and second braids 10, 20. Each of the first braids 10 has a plurality of first crests 11 and a plurality of first troughs 12 arranged alternatively along the horizontal direction, each of the second braids has a plurality of second crests 21 and a plurality of second troughs 22 arranged alternatively along the horizontal direction, and in the thickness direction of the woven textile each said second crest 21 is interposed between two adjacent ones of the plurality of first troughs 12. The at least one third braid 50 extends in a sinusoidal wave pattern across each of the plurality of first crests 11, and the at least one third braid 50 extends in a sinusoidal wave pattern across each of the plurality of second crests 21. The at least one first binding thread 30 itself knots to form a plurality of first knots 31, and between every adjacent two of the plurality of first crests 11 is at least one of the plurality of first knots 31, the at least one second binding thread 40 itself knots to form a plurality of second knots 41, and between every adjacent two of the plurality of second crests 21 is at least one of the plurality of second knots 41. The at least one first binding thread 30 knots within each of the plurality of first crests 11 and ties the at least one third braid 50 to each of the plurality of first crests 11, and the at least one second binding thread 40 knots within each of the plurality of second crests 21 and ties the at least one third braid 50 to each of the plurality of second crests 21. Specifically, each of the first braids, the second braids, and the third braid can include an outer layer and a core. The outer layer is woven by a plurality of filaments to be tube-shaped. The core is inserted through the outer layer. Besides, each of the first braids, the second braids, and the third braid is woven by braiding.

A first part 51 of the at least one third braid 50 extends in the longitudinal direction respectively from adjacent two of the plurality of first crests 11 toward one said first trough 12 connected to the adjacent two of the plurality of first crests 11 and curves between adjacent two of the plurality of second crests 21 which correspond to the adjacent two of the plurality of first crests 11 in the longitudinal direction, respectively. A second part 52 of the at least one third braid 50 extends in the longitudinal direction respectively from adjacent two of the plurality of second crests 21 toward one said second trough 22 connected to the adjacent two of the plurality of second crests 21 and curves between another adjacent two of the plurality of first crests 11 which correspond to the adjacent two of the plurality of second crests 21 in the longitudinal direction, respectively. The first part 51 of the at least one third braid 50 and the second part 52 of the at least one third braid 50 are overlapped with each other and are tied to each other by the at least one first binding thread 30 and the at least one second binding thread 40.

Thereby, the first binding thread and the second binding thread can restrict the horizontal elasticity of the first zone and the second zone, and the third braid can restrict the longitudinal elasticity of the woven textile. Thus, the elasticity of the woven textile is restricted in two different directions. Specifically, the first binding thread and the second binding thread restrict the elasticity more, and the jumping third braid restricts the elasticity less. Because the horizontal elasticity is larger than the longitudinal elasticity of the first zone and the second zone originally, the elasticity is balanced by the first binding thread, the second binding thread, and the third braid. Thus, the woven textile can be prevented from deforming caused by stretching.

What is claimed is:

1. A woven textile, defining a longitudinal direction and a horizontal direction perpendicular to the longitudinal direction, the longitudinal direction and the horizontal direction being perpendicular to a thickness direction of the woven textile, the woven textile including:

at least one first zone, including at least one first braid, the at least one first braid being woven by a plurality of filaments and extending in a sinusoidal wave pattern in both the longitudinal direction and the horizontal direction;

at least one second zone, including at least one second braid, the at least one second braid being woven by a plurality of filaments and extending in a sinusoidal wave pattern in both the longitudinal direction and the horizontal direction, the at least one first zone and the at least one second zone are aligned along the longitudinal direction;

at least one first binding thread, extending along the horizontal direction and woven with the at least one first braid;

at least one second binding thread, extending along the horizontal direction and woven with the at least one second braid;

at least one third braid, extending in a sinusoidal wave pattern between the at least one first and second zones;

wherein the at least one first binding thread at least ties the at least one third braid to the at least one first braid, and the at least one second binding thread ties the at least one third braid to the at least one first and second braids;

wherein each of the first braids has a plurality of first crests and a plurality of first troughs arranged alternatively along the horizontal direction, each of the second braids has a plurality of second crests and a plurality of second troughs arranged alternatively along the horizontal direction, and in the thickness direction of the woven textile each said second crest is interposed between two adjacent ones of the plurality of first troughs;

wherein the at least one third braid extends across each of the plurality of first crests, and the at least one third braid extends across each of the plurality of second crests;

wherein the at least one first binding thread knots within each of the plurality of first crests and ties the at least one third braid to each of the plurality of first crests;

wherein the at least one second binding thread knots within each of the plurality of second crests and ties the at least one third braid to each of the plurality of second crests;

wherein a first part of the at least one third braid extends in the longitudinal direction respectively from adjacent two of the plurality of first crests toward one said first trough connected to the adjacent two of the plurality of first crests and curves between adjacent two of the plurality of second crests which correspond to the adjacent two of the plurality of first crests in the longitudinal direction, respectively;

wherein a second part of the at least one third braid extends in the longitudinal direction respectively from adjacent two of the plurality of second crests toward one said second trough connected to the adjacent two of the plurality of second crests and curves between another adjacent two of the plurality of first crests which correspond to the adjacent two of the plurality of second crests in the longitudinal direction, respectively;

wherein the first part of the at least one third braid and the second part of the at least one third braid are overlapped with each other and are tied to each other by the at least one first binding thread and the at least one second binding thread.

2. The woven textile of claim 1, wherein the first zone and the second zone overlap partially.

3. The woven textile of claim 1, including a plurality of the first zones, a plurality of the second zones, a plurality of the first binding threads, and a plurality of the second binding threads, the first zones and the second zones being alternatively along the longitudinal direction.

4. The woven textile of claim 3, wherein the first binding threads are a single thread to extend back and forth, the second binding threads are a single thread to extend back and forth.

5. The woven textile of claim 3, wherein the first crests and the second crests positionally correspond to each other, the first troughs and the second troughs positionally correspond to each other, each of the first crests of each of the first braid partially overlaps one of the second troughs of an adjacent second braid, each of the first troughs of each of the first braid partially overlaps one of the second crests of an adjacent second braid.

* * * * *